US006035162A

United States Patent [19]

Chigono

[11] Patent Number: 6,035,162

[45] Date of Patent: Mar. 7, 2000

[54] CHARGING DEVICE AND IMAGE FORMING APPARATUS

[75] Inventor: Yasunori Chigono, Susono, Japan

[73] Assignee: Canon Kabushiki Kaisha, Tokyo, Japan

[21] Appl. No.: 09/140,405

[22] Filed: Aug. 26, 1998

[30] Foreign Application Priority Data

Aug. 26, 1997 [JP] Japan ..... 9-229474

[51] Int. Cl.[7] ..... G03G 15/02

[52] U.S. Cl. ..... 399/175; 399/176

[58] Field of Search ..... 399/89, 100, 174, 399/175, 176, 168; 361/225, 230, 235

[56] References Cited

U.S. PATENT DOCUMENTS 5,774,769 6/1998 Chigono et al. ..... 399/176
5,835,821 11/1998 Suzuki et al. ..... 399/100

FOREIGN PATENT DOCUMENTS 6-3921 1/1994 Japan .

*Primary Examiner*—Matthew S. Smith
*Assistant Examiner*—Hoan Tran
*Attorney, Agent, or Firm*—Fitzpatrick, Cella, Harper & Scinto

[57] ABSTRACT

A charging apparatus for charging a member to be charged which has a surface layer having a volume resistivity of $1\times10^{9}$–$1\times10^{14}$ Ωcm; a charging member contactable to the member to be charged to electrically charge the member to be charged, the charging member being supplied with a voltage having an AC voltage component; wherein e time constant τ (sec) of the member to be charged and the charging member, a frequency f (Hz) of the AC voltage component, and an effective voltage $V_{AC}$ (V) of the AC voltage component, satisfy:

$$2V_{AC}\{1-\exp(-\tfrac{1}{2}f/\tau)\}/\{1+\exp(-\tfrac{1}{2}f/\tau)\}\leqq 50.$$

13 Claims, 8 Drawing Sheets

CHARGING DEVICE AND IMAGE FORMING APPARATUS

FIELD OF THE INVENTION AND RELATED ART

The present invention relates to a charging device having a charging member contactable to a member to be charged (or to be discharged) to charge the member to be charged such as a photosensitive member or a dielectric member, and to an image forming apparatus having such a charging device.

In an image forming apparatus such as an electrophotographic type, electrostatic recording type or the like copying machine or printer, which forms an image using an image formation process including a step of charging an image bearing member such as an electrophotographic photosensitive member or an electrostatic recording dielectric member, a corona charger is ordinarily used to charge the member to be charged.

The corona charger is faced without contact to the member to be charged, and produces corona shower, to which the surface of the member to be charged is exposed, by which the surface of the member to be charged is charged to a predetermined polarity and potential.

Recently, a contact charging device becomes used in an intermediate and low image forming apparatus because of the advantages of the low ozone and low electric power consumption over the corona charger.

It is supplied with a predetermined voltage and is contacted to the member to be charged to charge the surface of the member to be charged to predetermined polarity and potential. The contact charger is an electroconductive member, and may be in the form of an elastic roller (charging roller), blade (charging blade), magnetic brush (magnetic brush charger), furbrush (furbrush charger) or the like.

The magnetic brush charger has a magnetic brush portion of electroconductive magnetic particles carried on magnetic confinement on a rotatable or non-rotation carrying member functioning also as an electric energy supply electrode, by magnetic confinement, and the magnetic brush portion is contacted to the member to be charged, and the electric energy is supplied to the carrying member.

The furbrush charger includes a brush portion of electroconductive fibers carried on a rotatable or non-rotation carrying member functioning also as an electric energy supply electrode, and the electroconductive fiber brush portion is contacted to the member to be charged, and the electric energy is supplied to the carrying member.

The magnetic brush charger and a furbrush charger are preferably used because of the stability of the charging and contact.

In the contact charging, there are two types in one of which charging by discharge phenomenon is dominant, and in the other of which direct injection of the charge to the surface of the member to be charged is dominant (charge injection contact type).

Charge injection contact type is disclosed in Japanese Laid-open Patent Application No. HEI-6-3921, for example. In this type, the contact charger is supplied with a voltage, and the charge is injected from the contact charger contacted to the photosensitive member surface (float electrode on the photosensitive member) of the member to be charged having a charge injection layer. More particularly, Japanese Laid-open Patent Application No. HEI-6-3921 discloses that use can be made with a material of acrylic resin material in which $SnO_2$ made electro-conductive by antimony-doping (electroconductive filler (electroconductive particle)) is dispersed, painted on the photosensitive member surface to provide a charge injection layer.

Such a charge injection contact type does not use the discharge phenomenon, the photosensitive member can be charged to a desired surface potential by application, to the contact charger, of the DC voltage equal to the desired surface potential of the photosensitive member, and the ozone is not produced.

The voltage applied to the contact charger in the contact charging device, may be a DC voltage (DC bias) only (DC applying type), and an oscillating voltage in the form of a DC voltage biased with an AC voltage (AC bias) (voltage having a voltage level which periodically changes) (AC applying type).

With the DC applying type, the improper charging tends to occur by the rise of the resistance attributable to the contamination or modification of the property of the contact charger, or the ambient condition variation. As contrasted, the AC applying type exhibits a better uniform charging property and stability against ambience even if a high resistance contact charger is used, because of the application of the AC bias.

However, the AC applying type involves an improper charging in the form of a fine potential non-uniformity on the surface of the member to be charged attributable to the application of the AC bias, and when the contact type AC applying type is used to charge the image bearing member in an image forming apparatus such as an electrophotographic apparatus, the fog (AC fog) due to the application of the AC bias appears on the output image, which may deteriorate the quality of the recorded image.

The fog is an image defect caused by small amount of toner on the white background in the image, which deteriorates the optical contrast of the image.

In a contact charging type using the charge injection, the charge is directly injected from the contact charger to the member to be charged to effect the charging, the member to be charged can be linearly charged in proportion to the applied bias. In other words, the potential of the member to be charged is substantially linearly proportional to the DC voltage applied to the charger. Therefore, the charging is possible only by the DC bias, but since the operation is repeated in the image forming apparatus, the contact charger is gradually contaminated with the toner or the like, with the result that resistance thereof increases, and the image defect due to the improper charging occurs. A contact charger of an AC applying type having a high resistance exhibits the uniform charging and the stability against ambience, but the image non-uniformity and fog may occur due to the AC bias application. In the charge injection contact type, the member to be charged is charged to the potential which is substantially equal to the voltage applied to the contact charger, the fine potential non-uniformity tends to occur if the AC bias is used in an attempt to charge it at high speed with stability.

SUMMARY OF THE INVENTION

Accordingly, it is a principal object of the present invention to provide a charging device and an image forming apparatus wherein the improper charging does not easily occur even if the charging member is contaminated with toner or the like.

It is another object of the present invention to provide a charging device and an image forming apparatus wherein the potential non-uniformity attributable to the application of the AC voltage to the charging member is suppressed.

It is a further object of the present invention to provide an image forming apparatus wherein image non-uniformity and fog attributable to the application of the AC voltage to the charging member is removed, so that high quality image can be formed for a long term.

It is a further object of the present invention to provide a charging device and an image forming apparatus wherein the charge is injected from the charging member to the member to be charged at the contact portion between the charging member and the member to be charged with low ozone production.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<Embodiment 1>

(FIGS. 1–7)

(1) Outline of an Example of an Image Forming Apparatus

Figure 1:
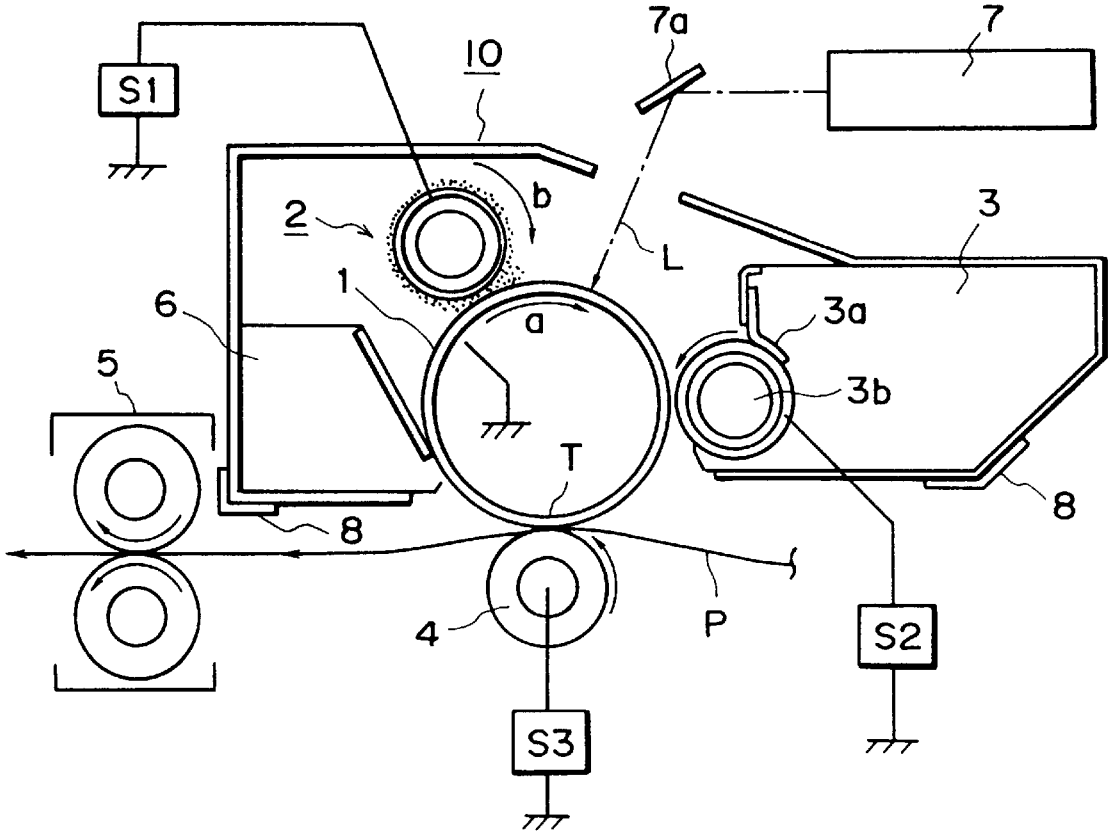
FIG. 1 is a schematic view of an image recording device according to Embodiment 1 of the present invention

FIG. 1 is a schematic illustration of an example of an image forming apparatus according to the present invention. The image forming apparatus of this example is a laser beam printer of an image transfer and electrophotographic type and a detachable process cartridge type.

Designated by 1 is a rotatable drum type electrophotographic photosensitive member as an image bearing member (member to be charged), and is rotated about the center thereof at a predetermined peripheral speed (process speed), 100 mm/sec in this example, in the clockwise direction indicated by arrow a. The photosensitive member of the example is an OPC photosensitive member (organic photosensitive member) and has a surface charge injection layer. This will be described in detail in (3) hereinafter.

Designated by 2 is a contact charger for the photosensitive member 1, and is in the form of a magnetic brush charger of rotatable sleeve type, wherein the sleeve is rotated in the clockwise direction b in this example. This will be described in detail in (4) hereinafter.

The magnetic brush charger 2 is supplied with a superimposed voltage of a predetermined DC bias and AC bias as a charging bias, supplied from a charging bias applying voltage source S1 (AC applying type), and the rotating photosensitive member surface is charged to a predetermined polarity and potential through contact charge injection. In this example, it is charged to approx. −700 V.

The thus charged surface of the photosensitive member 1 is subjected to a laser beam scanning exposure L by a laser scanner 7 (exposure device) so that electrostatic latent image is formed, corresponding to the intended image. The laser scanner 7 emits a laser beam L modulated in accordance with a time series electrical digital pixel signal corresponding to the intended image information. Designated by 7*a* is a mirror for deflecting the emitted laser beam L from the laser scanner 7 toward the image exposure portion having the rotatable photosensitive member 1.

The electrostatic latent image of the rotatable photosensitive member surface is developed into a toner image by the developing device 3. In this example, a reverse development device is used wherein the toner is deposited onto the light portion of the electrostatic latent image to develop the latent image. Designated by 3*a* is a rotatable developing sleeve; 3*b* is a magnet roller in the developing sleeve; and S2 is a developing bias applying voltage source for the developing sleeve 3*a*. The developing sleeve 3*a* is opposed to the surface of the photosensitive member 1 with a gap of 0.3 mm, and is rotated in the counterclockwise direction indicated by an arrow, and toner particles charged to the negative polarity through triboelectric charge are applied on the peripheral surface thereof in the form of a thin layer and carried to the developing zone where it is opposed to the photosensitive member. The developing sleeve 3*a* is supplied with a developing bias of −500 V DC voltage biased with an AC voltage having a frequency of 2.0 KHz and a peak-to-peak voltage of 1.6 kV in this example from the developing bias applying voltage source S2, so that toner is selectively deposited from the developing sleeve 3*a* to the light portion of the electrostatic latent image of the photosensitive member 1 by the electric field, by which the electrostatic latent image is developed with the toner.

The toner image an the rotatable photosensitive member 1 is transferred onto a recording material (transfer material) P supplied at a predetermined timing from the unshown sheet feeding mechanism portion to the transfer portion T, where the transfer device 4 is opposed to the photosensitive member 1. The transfer device 4 in this example is in the form of a transfer roller contacted to the photosensitive member, the transfer roller 4 is supplied with a transfer bias of a predetermined voltage and of the opposite polarity from the charge polarity of the toner, from the transfer bias application voltage source S3, and the toner image is electrostatically transferred from the surface of the photosensitive member 1 onto the surface of the recording material P introduced to the transfer portion T. The recording material P now having the transferred toner image at the transfer portion T, is separated from the rotatable photosensitive member surface and is introduced Into the fixing device 5, where the toner image is fixed, and then it is discharged as a print.

After the recording material separation, the surface of the rotatable photosensitive member is cleaned by a cleaning device 6 so that deposited residual matter such as toner is removed from the surface to be prepared for the next image formation.

(2) Process Cartridge 10

Designated by 10 is a process cartridge detachably mountable to a predetermined portion in the main assembly of the printer. In this example, the process cartridge 10 contains as a unit the Photosensitive member 1 as the image bearing member, the magnetic brush charger 2 as the contact charging member, the developing device 3 and the cleaning device 6 (four process means). The cartridge may contain the photosensitive member 1 and at least one of the charger 2, the developing device 3 and the cleaning device 6.

By mounting such process cartridge 10 to a predetermined portion of the main assembly of the printer, the mechanical and the electrical connections are established between the process cartridge 10 and the main assembly, so that image forming operation enabled state is enabled. Designated by 8, 8 are guiding members functioning also as holding members for mounting-and-demounting of the process cartridge 10.

Figure 2:
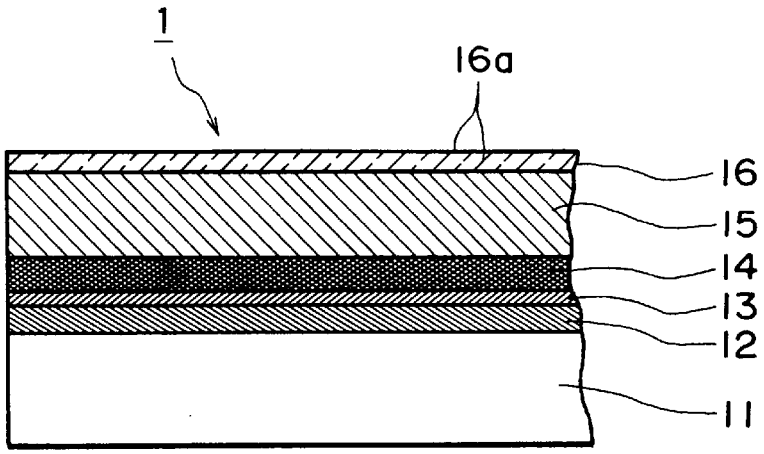
FIG. 2 is a schematic view of layer structure of a photosensitive member.

(3) Photosensitive Member 1 (FIG. 2)

As described hereinbefore, the photosensitive member 1 of this embodiment is an OPC photosensitive member (organic photosensitive member) having a surface charge injection layer.

FIG. 2 is a schematic view of layer structure of the photosensitive member 1. Designated by 11 is a drum base of aluminum (Al drum base), and a primary layer 12, a positive charge injection preventing layer 13, a charge generating layer 14 and a charge transfer layer 15, are sequentially painted in the order named to form an usual OPC photosensitive layer, and a charge injection layer 16 is applied thereon.

The charge injection layer 16 of this example is provided by mixing and dispersing $SnO_2$ ultra-fine particle 16*a* having a particle size of 0.3 $\mu$m as electroconductive particles and lubricant such as tetrafluoroethylene resin material (Teflon), polymerization initiator and the like in photo-curing type acrylic resin material, and applying it and forming it into a film through photo-curing method. A volume resistivity of the charge injection layer 16 is Preferably in the range of $1\times10^9$–$1\times10^{14}$ ($\Omega\cdot$cm). The measurement of the volume resistivity of the charge injection layer is carried out using a HIGH RESISTANCE METER 4329A available from Yokogawa Hewlett-Packard Kabushiki Kaisha to which a RESISTIVITY CELL 16008A is connected and the measurement is carried out for a sheet-like sample with 100 V applied thereacross.

The photosensitive layer may be of CdS, Si, Se or another inorganic semiconductor.

Figure 3B:
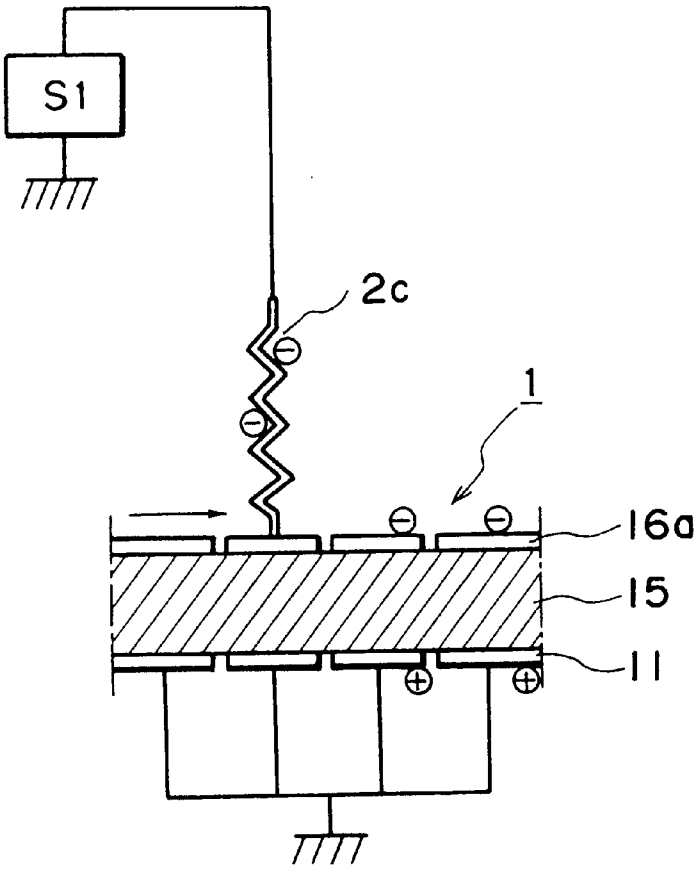
FIG. 3 is a schematic view of a charging circuit (a), and an equivalent circuit diagram thereof
Figure 3A:
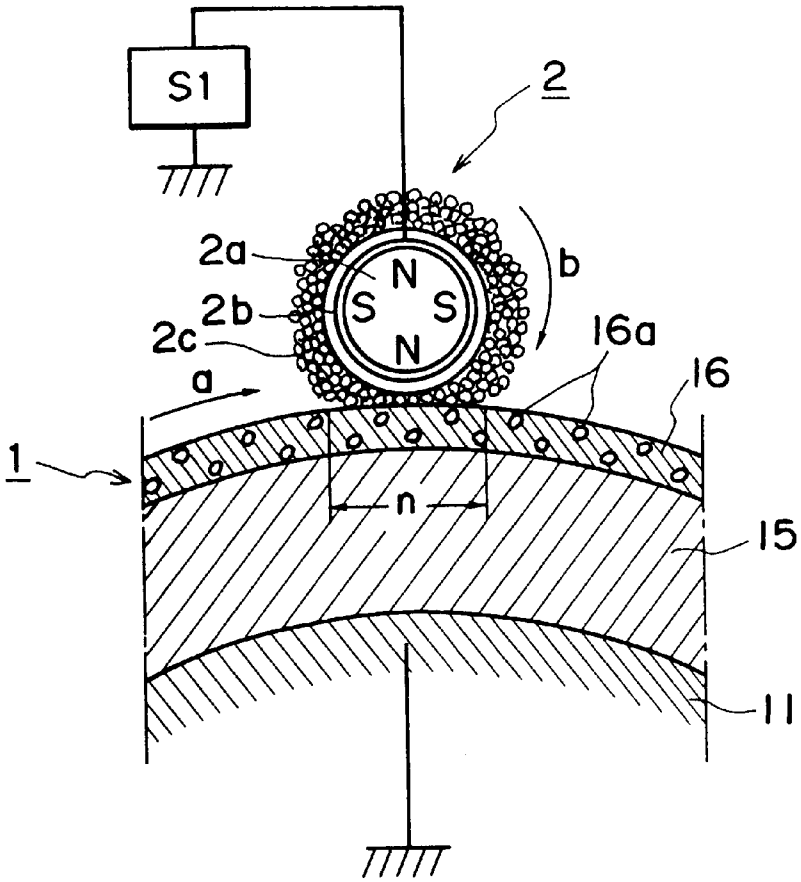

(4) Magnetic Brush Charger 2 (FIG. 3)

FIG. 3 is a schematic view of a charging circuit (a) and an equivalent circuit diagram thereof (b).

The magnetic brush charger 2 as the contact charging member in this example is of a rotatable sleeve type. The magnetic brush charger 2 comprises a non-rotatable magnet roller 2*a*, a non-magnetic electroconductive charging sleeve 2*b* having an average surface roughness of Ra 1.2 $\mu$m and loosely fitted around the magnet roller 2*a* for concentric rotation, and a magnetic brush layer 2*c* of electroconductive magnetic particles attracted on the outer surface of the charging sleeve 2*b* by the magnetic force of the magnet roller 2*a* in the charging sleeve.

The magnet roller 2*a* has four magnetic poles generating the magnetic flux density having a peak of 600 G in the radial direction on the surface of the charging sleeve, and one of which is opposed to the photosensitive member 1.

The electroconductive magnetic particles constituting the magnetic brush layer 2*c* have a predetermined resistance, configuration and magnetic property. For example, the particles are ferrite particles having an average particle size of 30 $\mu$m, a volume resistivity of approx. $5\times10^7$ ($\Omega$cm), and a saturation magnetization of 60 ($Am^2/kg$).

The volume resistivity of the electroconductive magnetic particles is measured as follows; 2 g of the electroconductive magnetic particles are placed in a cylindrical container having a bottom surface area of 228 $mm^2$, and are pressed at 15 Kg, and 100 V is applied between the top and bottom thereof, and the resistance is determined on the basis of the current, and is regularized. At this time, the height of the sample is approx. 3 mm, and the electric field is $3.3\times10^2$ (V/cm).

The electroconductive magnetic particles may be ferrite particles, magnetite particles or another magnetic metal particles, or may be such magnetic particles bound by binder resin material. The volume resistivity is preferably $1\times10^7$–$1\times10^9$ $\Omega$cm. The particle size is preferably 5–50 $\mu$m. By mixing a plurality of magnetic particles, the charging property can be improved. The structure of the charging nip, the resistance of the electroconductive magnetic particles, and the particle size thereof have properties such that conditions which will be described hereinafter are satisfied as the entire charger when the magnetic brush is constituted.

The average particle size of the electroconductive magnetic particles is expressed as a maximum angular distance in the horizontal direction, and the measuring method is as follows; not less than 300 particles are selected at random, and the diameters thereof are measured through a microscopic method, and the arithmetic average are calculated.

For a magnetic property measurement of the electroconductive magnetic particle, a DC magnetization B-H type automatic property recording device BHH-50 available from Riken Denshi Kabushiki Kaisha, Japan is used. At this time, approx. 2 g of electroconductive magnetic particles are placed in a cylindrical container having a height of 10 mm and a diameter (inner diameter) of 6.5 mm; and while the particle are immobile, the saturation magnetization is determined from a B-H curve. The magnetic brush charger 2 is disposed substantially parallel with the photosensitive member 1 with a gap of approx. 0.5 mm between the surface of the charging sleeve 2*b* and the surface of the photosensitive member 1 by spacer members (unshown) contacted to the surface of the photosensitive member at the longitudinal end portions, so that magnetic brush layer 2*c* is contacted to the photosensitive member 1 surface with a charge portion (charging nip) of a predetermined width The charging sleeve 2*b* is rotated at peripheral speed of 100 mm/sec which is the same as the peripheral speed of the photosensitive member 1 in the opposite direction (clockwise direction b) at the charge portion n, by which the magnetic brush layer 2*c* rotates in the same direction to rub it.

The magnetic brush resistance of the magnetic brush of the electroconductive magnetic particles, is approx. $1\times10^6\Omega$ when 100 V is applied, and is $1\times10^5\Omega$ when 1000 V is applied. The resistance is measured as follows; the magnetic brush is contacted to an aluminum cylinder as a substitute for the photosensitive member in the same conditions, and a predetermined voltage is applied between the aluminum cylinder and the magnetic brush. The width of the magnetic brush charger is 23 cm. The resistance of the magnetic brush thus measured is preferably $1\times10^4$–$1\times10^7\Omega$.

The following voltage is applied from the charging bias applying voltage source S1 to the charging sleeve 2*b* of the magnetic brush charger 2 during the charging operation:

DC bias: −700 V

AC bias: effective voltage of 500 V of frequency 2000 Hz (rectangular wave)

By this application of the superimposed voltage, the charge is injected into the charge injection layer 16 of the photosensitive member 1 at the charge portion n via the electroconductive magnetic particles of the magnetic brush layer 2*c*, so that photosensitive member surface is charged to substantially the same potential as the DC bias level of the applied charging bias to the magnetic brush charger 2.

In the charge injection charging, the charge injection is effected into the surface of the member to be charged (photosensitive member) having an intermediate surface resistance, by an intermediate resistance contact charging member, and does not, in this invention, inject the charge to the trap potential of the photosensitive member surface material, but the electroconductive particles ($SnO_2$) 16*a* in the charge injection layer 16 are electrically charged. As shown in the equivalent circuit shown in FIG. 3, (b), the contact charging member 2 charges the fine capacitors constituted by the dielectric member which is the charge transfer layer 15 and electrode plates which are the aluminum drum base 11 and the electroconductive particles 16*a* in the charge injection layer 16. The electroconductive particles 16*a* are electrically independent, and constitute a sort of fine float electrodes. So, the photosensitive member surface seems macroscopically to be charged to a uniform potential, but actually, a great number of fine electroconductive particles of $SnO_2$ covers the photosensitive member surface. Therefore, when the image exposure L is effected by a laser beam, the electrostatic latent image produced thereby can be maintained because the $SnO_2$ particles 16*a* are electrically independent in the dark portion.

(5) Charging Property of the Apparatus

In a charging using charge injection, the charging property of the photosensitive member 1 as the member to be charged, can be known by observing the process of the photosensitive member potential rise when a DC voltage is applied to the contact charger 2.

Using an equivalent circuit, the charging system constituted by voltage source SI—magnetic brush charger 2—photosensitive member 1 in (a) of FIG. 3, are represented by a capacitor (photosensitive member 1), a resistance (magnetic brush charger 2) as shown in (b) of FIG. 3, and the charging is understood as the charging of the capacitor in the series circuit having the capacitor and the resistance.

The charging voltage Vd (V) of the photosensitive member 1 is expressed as follows, when a DC voltage applied to the photosensitive member 1 as the member to be charged through the magnetic brush charger 2 as the contact charger is V (V), a time constant is τ (sec), and the elapsed time after the application is t (sec):

$$Vd=V(1-\exp(-t/\tau)) \quad (1)$$

or $$ln|V-Vd|=-t/\tau+lnV \quad (2)$$

From equation (2), it is understood that ln|V−Vd| and t are in line relation.

Figure 4B:
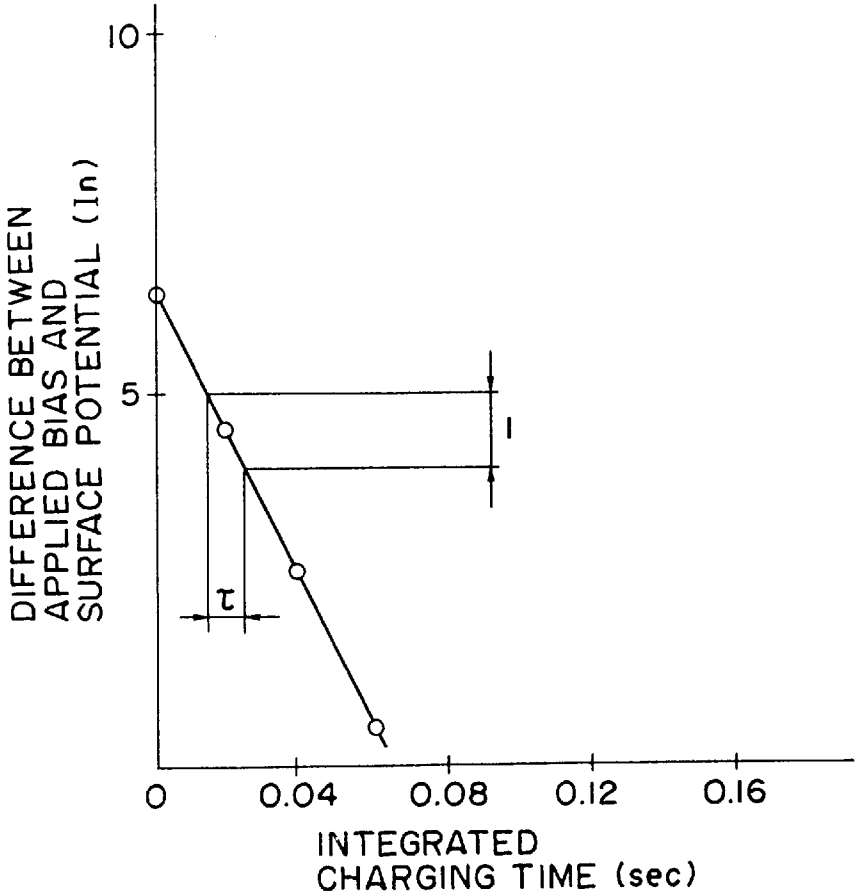
FIG. 4 is a graph showing change of the surface potential of the photosensitive member during charging (a), and a charging property graph (b).
Figure 4A:
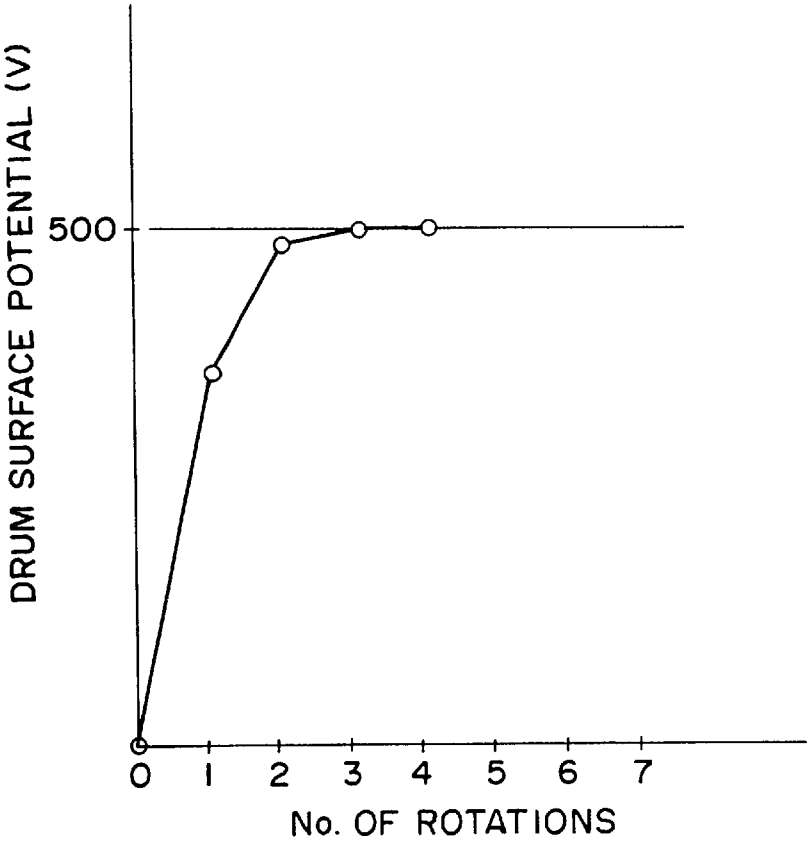

In (a) of FIG. 4, there is shown rise of the potential of the photosensitive member surface when the photosensitive member 1 is rotated a plurality of turns continuously while applying only a DC voltage to the sleeve 2*b* of the magnetic brush charger 2. It is understood that surface potential rises with rotations.

The charging is effected intermittently only when the photosensitive member 1 is contacted to the magnetic brush charger 2, and in order to analyze the charging development, it is required to calculate the net charging time. FIG. 4, (b) shows the results of calculation of the charging time from the bias application start by integrating the charging nip passing time duration tnip (sec) for the turns of the photosensitive member.

The charging nip passing time duration tnip is obtained by tnip=Lnip/Vps where Vps is a peripheral speed (mm/sec) of the photosensitive member 1, and Lnip (mm) is a net charging nip width.

As regards the charging nip width Lnip, the contact between the magnetic brush layer 2*c* of the magnetic brush charger 2 and the photosensitive member 1 is non-uniform in the circumferential direction, the net charging nip width contributable to the charging is narrower than a plausible contact nip width.

Here, the time duration in which the charging occurs is precisely defined.

To do this, the drum is rubbed with strong contact, and the nip is determined from the resultant scrapping. More particularly, the photosensitive drum or another drum having the similar polycarbonate surface layer is fixed, and only the charging brush is rotated to scrape the drum. Then, the scraped profile of the drum surface is determined using a surface roughness meter available from Kosaka Lab, Japan, and the effective nip is determined. In order to determine the unsmoothness profile in the longitudinal direction of the drum, it is desirable to use a two-dimensional surface roughness meter which can determine the unsmoothness on the two dimensional surface. In order to determine the net scraped amount of the cylindrical drum, a part of the drum nip is masked to provide unscraped portion adjacent to the scraped portion, and the difference is used to correctly determine the scrap amount. The nip width is determined as a width wherein the scraped amount is not less than 10% of the maximum scraped amount in a graph of plots of the scraped amount in the circumferential direction positions. With the structure of the embodiment, the actual nip width was 1–4 mm.

The charging time is determined by integrating the charging nip passing time thus obtained, and in FIG. 4, (b), the ordinate is a natural logarithm function of the absolute value of the difference between the applied bias V (V) and the surface potential of the photosensitive member Vd (V), i.e., the left-hand side ln|V−Vd| of the equation (2). From this Figure, substantially the linear relation is understood, and therefore, it is confirmed that charging process is that of the equivalent circuit.

From (b) of FIG. 4, the time constant τ can be determined. The time constant τ thud obtained, is important in determining the structure for removing the fog.

As described hereinbefore, when the DC+AC bias voltage is used in a conventional charge injection type, there is a problem that potential non-uniformity and fog is produced. With this charging type, the photosensitive member 1 can be charged to a potential which is substantially equal to the bias applied to the magnetic brush charger 2 (contact charger), the non-uniformity of the bias tends to influence the potential of the photosensitive member 1. Actually, even when the period is sufficiently small in terms of the image recording, the fine charging non-uniformity may appear as a fog.

In the present invention, the fact that charging property of the charge injection type is determined by the time constant of the circuit having the resistance and the capacitor, is used to suppress the potential variation of the photosensitive member surface to less than a predetermined level.

In the equivalent circuit, a voltage change ΔV (potential deflection width of the photosensitive member surface) which normally occurs is determined using an ideal rectangular wave as the applied bias to the charger. Here, ΔV is a fine potential non-uniformity on the surface of the member to be charged attributable to the AC bias.

Figure 9:
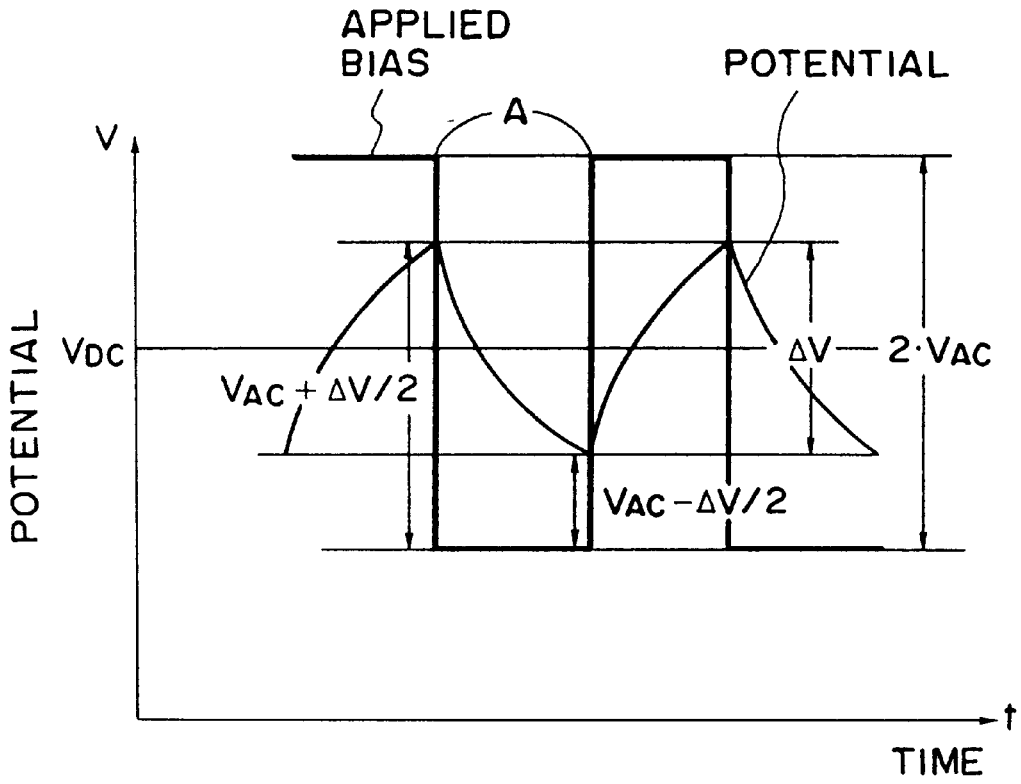
FIG. 9 is a graph of applied bias to the charger vs. surface potential of the photosensitive member.

FIG. 9 shows a charged potential of the photosensitive member surface vs. an applied bias to the charger. Noting a waveform in a single pulse A, the following equation (3') results:

$$\exp(-\tfrac{1}{2}f/\tau)=(2\cdot V_{AC}-\Delta/2)/(2\cdot V_{AC}+\Delta/2) \quad (3')$$

VAC (V) is an effective voltage of the applied AC bias, f (Hz) is a frequency of the applied AC bias, and τ (sec) is a time constant of the charging device determined through the foregoing method. From equation (3'), ΔV is determined as follows:

$$\Delta V=2V_{AC}\cdot\{1-\exp(-\tfrac{1}{2}f/\tau)\}/\{1+\exp(-\tfrac{1}{2}f/\tau)\} \quad (3)$$

Here, the AC bias is in the form of a rectangular wave, but it may be used in the case of a triangular wave or sin wave. Therefore, the AC bias voltage is expressed as an effective voltage.

In (b) of FIG. 4, the time constant τ is determined from the inclination of the line, but it is not completely linear in the actual charging process. Here, it is preferable that time constant is determined from the inclination of a tangent line at the point of the potential difference (a difference between the applied DC bias and the surface potential) equal to the effective voltage value of the AC bias.

Figure 5:
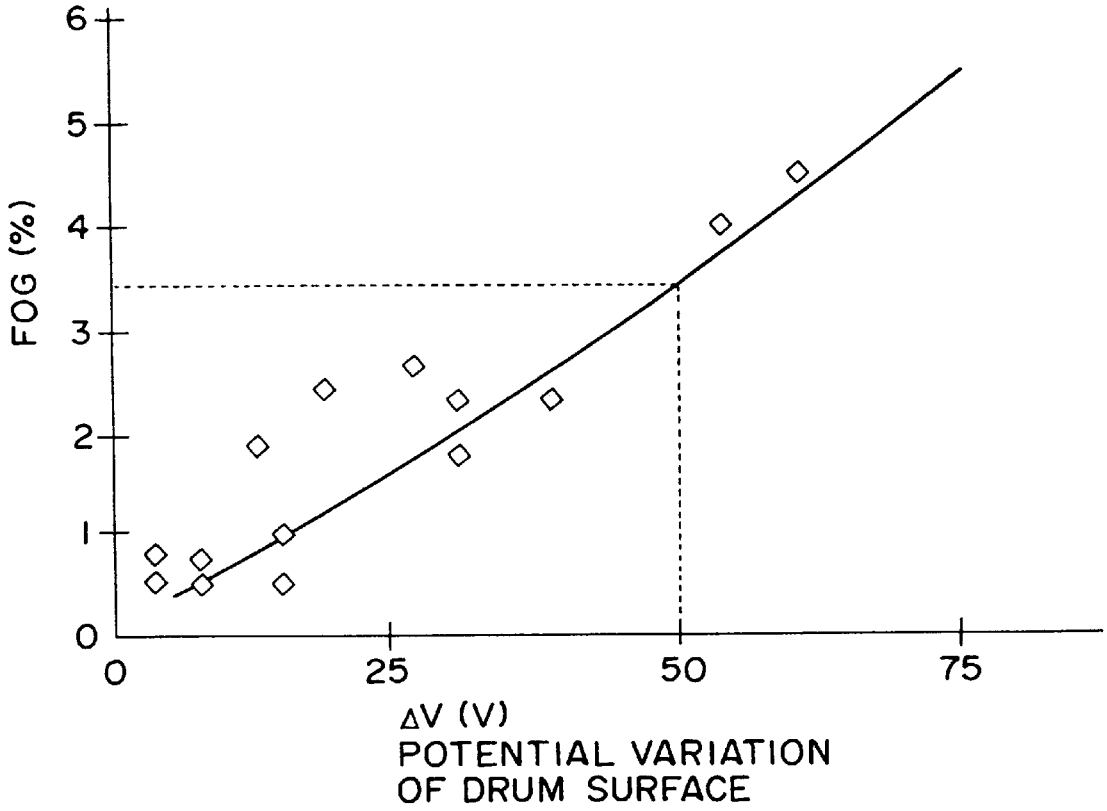
FIG. 5 shows ΔV vs. fog.

As a result of analysis and consideration in this manner by the inventor, an interrelation between the width ΔV of the potential deflection of the photosensitive member surface and the fog, is obtained. FIG. 5 shows the relation.

As the fog, a difference between the reflectance of the recording paper before the recording and the reflectance of the non-image portion after the recording, is taken. When the fog exceeds 3–4%, it is remarkable, and the density is increased in the intermediate density portion.

In the graph of FIG. 5, ΔV when the fog is 3.5% is 50 (V).

Therefore, $$\Delta V \leqq 50 \quad (4)$$

Using equation (3), $$2V_{AC}\cdot\{1-\exp(-\tfrac{1}{2}f/\tau)\}/\{1+\exp(-\tfrac{1}{2}f/\tau)\}\leqq 50 \quad (5)$$

By determining the frequency f of the applied AC bias voltage, the effective voltage $V_{AC}$ and/or the time constant τ of the charging system, the fog can be suppressed.

In a magnetic brush charging, the time constant can be determined from the electrostatic capacity of the photosensitive member and the magnetic brush resistance, but the value obtained therefrom is influenced by substantial contact state between the photosensitive member and the magnetic brush or the field intensity dependence, and therefore, it is difficult to determine the actual charged potential. The magnetic brush resistance, the particle property, the outer shapes of the magnetic brush charger and the drum influence the fog in a complicated manner, but according to the present invention, actual time constant, bias condition and process speed which are very much influential to the fog are used to suppress the fog attributable to the magnetic brush.

The present invention is compared with comparison examples

Table 1 gives the time constants, an integer multiple of the effective AC voltages, the frequencies, widths ΔV of the potential deflections on the photosensitive member surface calculated from equation (3), and the actual fogs in Embodiment 1 and Comparison Example 1.

TABLE 1

| | τ | $2xV_{AC}$ | f | ΔV | fog |
|---|---|---|---|---|---|
| Comp. Ex. 1 | 0.004 | 1000 | 1000 | 62 | 4.7% |
| Embodiment 1 | 0.004 | 1000 | 2000 | 31 | 1.8% |

Figure 6:
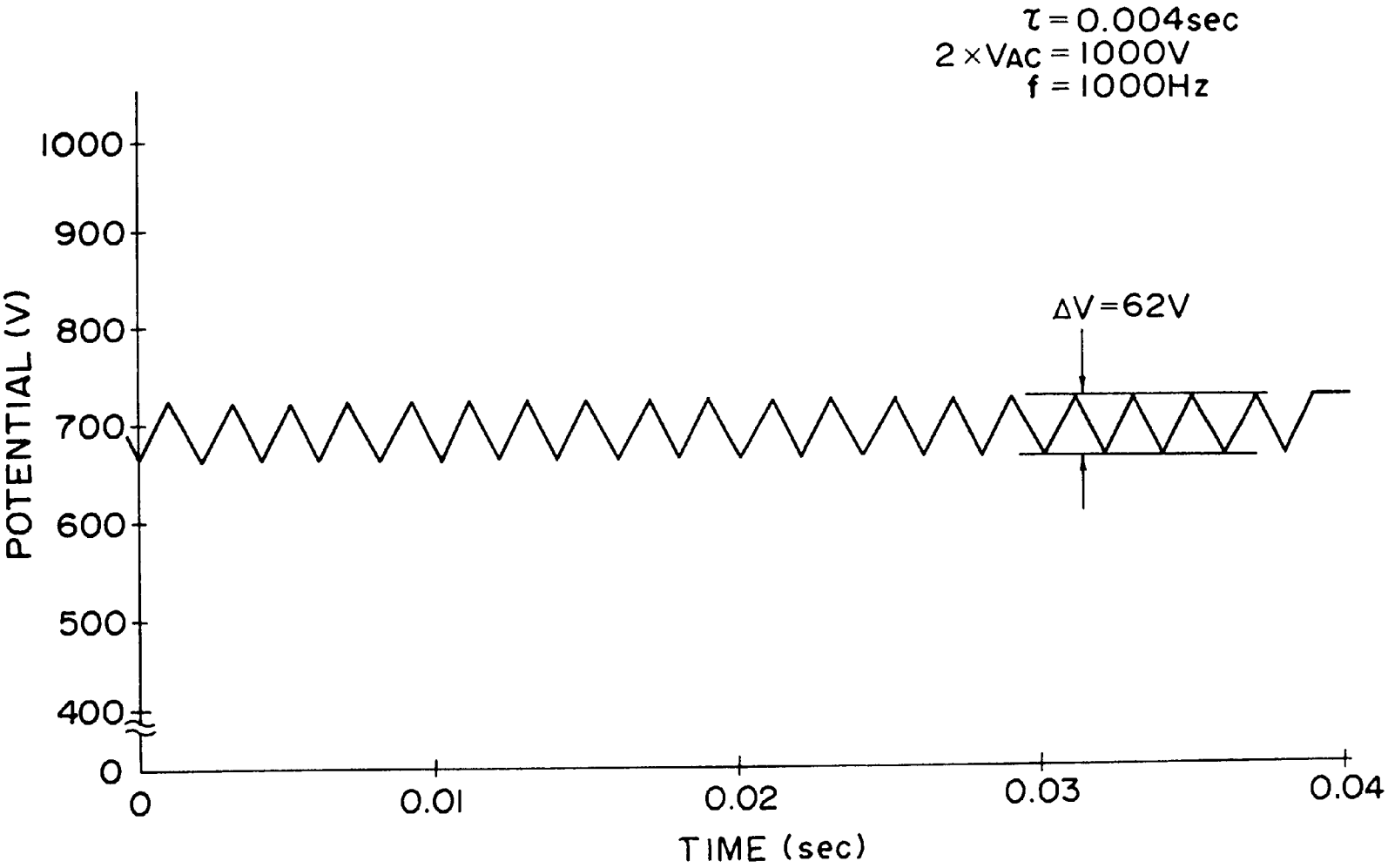
FIG. 6 shows a result of potential non-uniformity calculation in a Comparison Example 1.

With Comparison Example 1, the frequency is 1000 Hz, and the charging system having the corresponding time constant involves high potential non-uniformity, and ΔV is 62 V (FIG. 6) with the fog of 4.7%.

Figure 7:
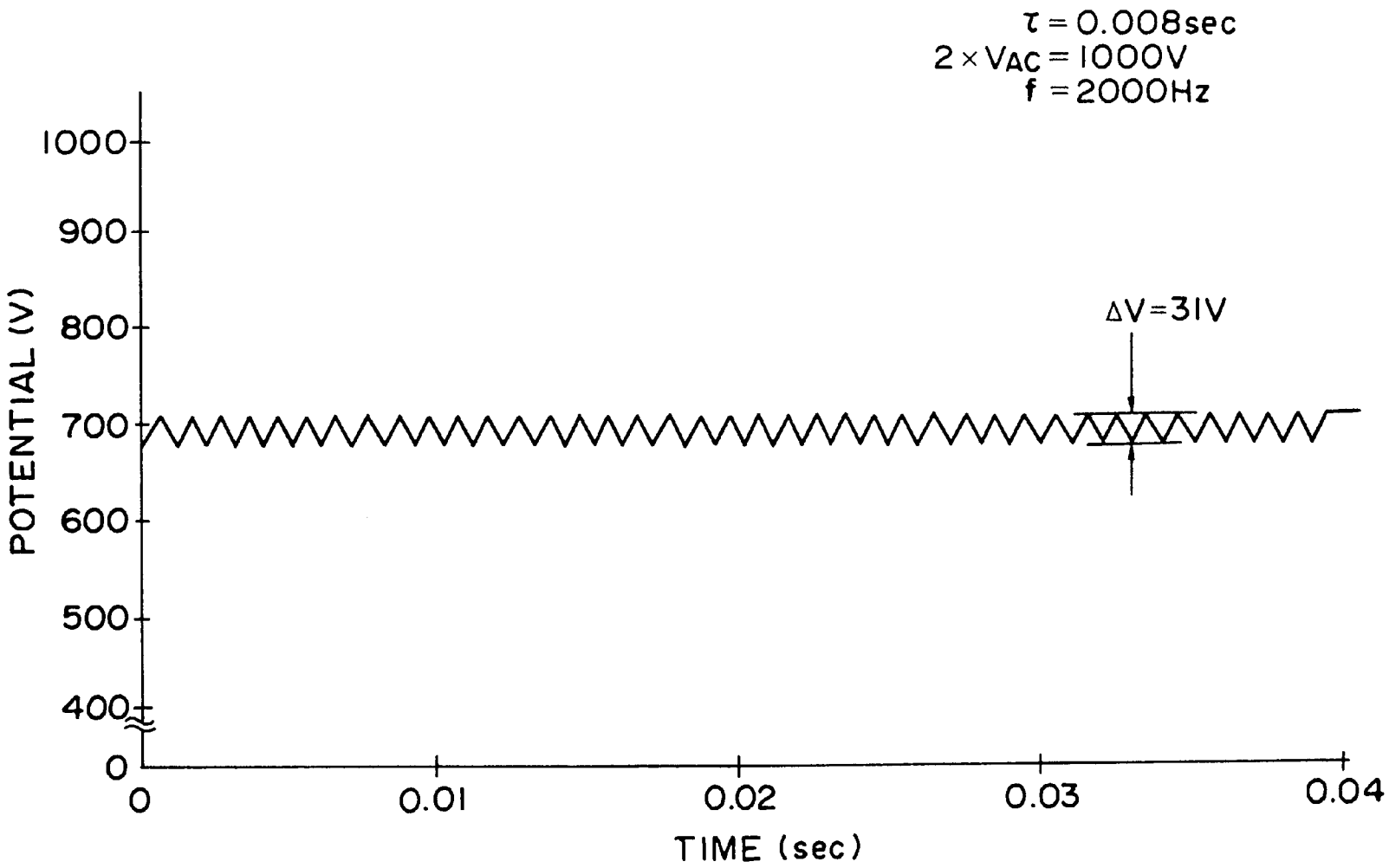
FIG. 7 is a graph showing a result of potential non-uniformity calculation in Embodiment 1.

On the other hand, in Embodiment 1, ΔV is 31 (FIG. 7), wherein equation (4) is satisfied. Therefore, the fog is small, i.e. 1.8%, and the image quality was satisfactory.

Thus, the image deterioration due to the application of the AC voltage is removed, by making the width ΔV of the potential deflection of the photosensitive member surface calculated from the AC voltage applied and the time constant τ of the charging system not more than 50 V, in Embodiment 1.

<Embodiment 2>

(FIG. 8)

In this embodiment, the electroconductive magnetic particles constituting the magnetic brush layer 2*c* of the magnetic brush charger 2 have the volume resistivity of $1\times10^8$ (Ω·cm) and an average particle size of 40 (μm), and the time constant of the charging system is 0.008 sec, so that fog does not easily occur even with the use of AC bias. This embodiment is the same as Embodiment 1 in the other respects. The magnetic brush resistance of the magnetic brush thus formed is approx. $2\times10^6\Omega$ when 100 V is applied, and approx. $4\times10^5\Omega$ when 1000 V is applied.

The comparison between this embodiment and Comparison Example 1 is summarized in Table 2.

TABLE 2

| | τ | $2xV_{AC}$ | f | ΔV | fog |
|---|---|---|---|---|---|
| Comp. Ex. 1 | 0.004 | 1000 | 1000 | 62 | 4.7% |
| Embodiment 2 | 0.008 | 1000 | 1000 | 31 | 2.3% |

Figure 8:
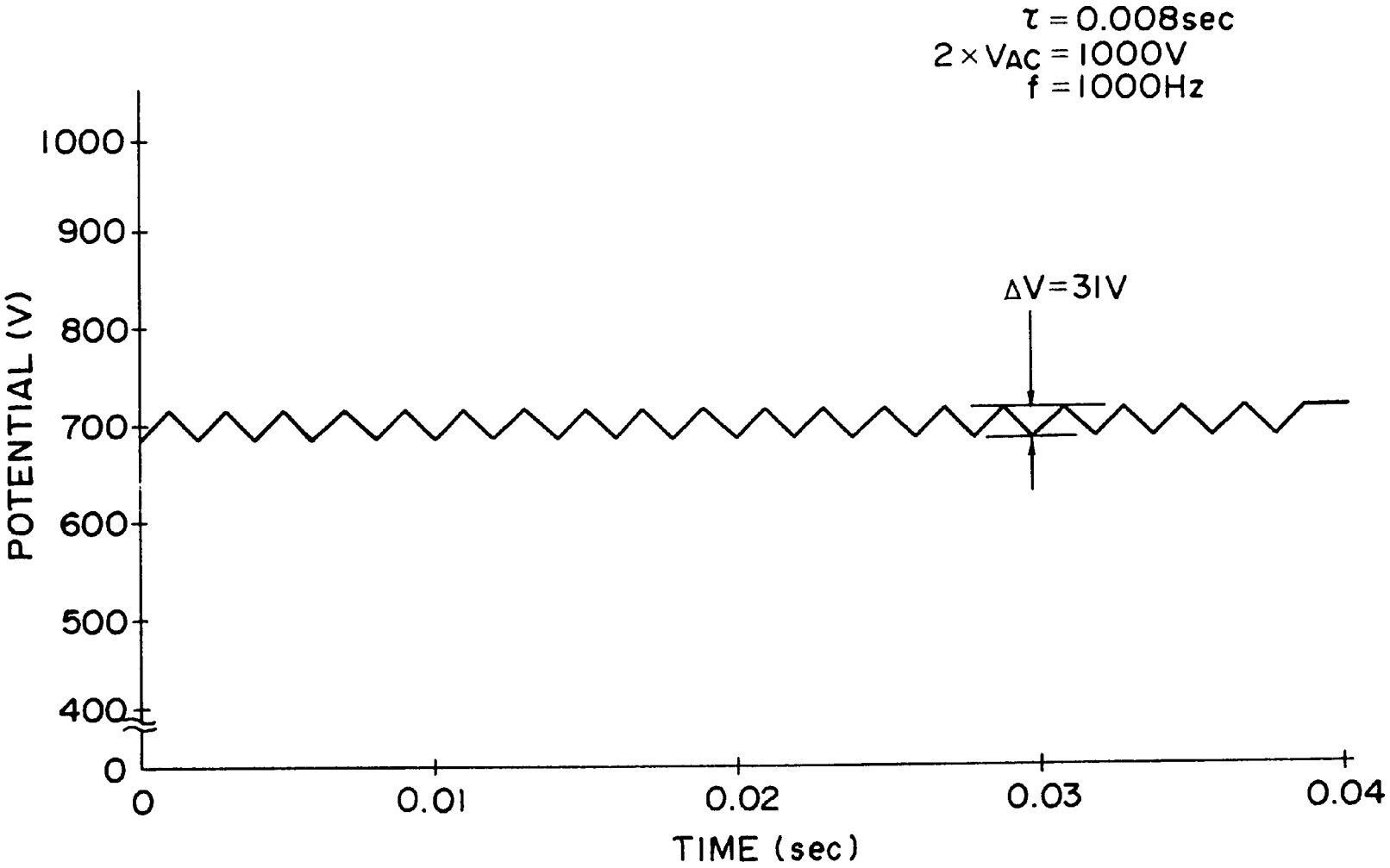
FIG. 8 is a graph showing a result of potential non-uniformity calculation in Embodiment 2.

In Comparison Example 1, ΔV=62 V (FIG. 6), and the fog is produced, but in Embodiment 2, the time constant of the charging system is slow, i.e., 0.008 sec, so that ΔV is decreased to 31 V (FIG. 8), and the fog is 2.3% which is proper.

In order to control the time constant of the charging system, the resistance and/or the electrostatic capacity is controlled in the charging system constituted by the voltage source S1—magnetic brush charger 2—photosensitive member 1, and by such adjustment, the similar effects are provided.

In this Embodiment 2, the resistance of the electroconductive magnetic particle and the particle size thereof are adjusted, but this is not inevitable and the gap between the sleeve 2*b* and the photosensitive member 1 and/or the capacity of the photosensitive member may be adjusted.

The particle size of the electroconductive magnetic particles is influential to the resistance of the entire system. There is a contact resistance between the electroconductive magnetic particles constituting the magnetic brush layer 2*c* and the photosensitive member 1, and more particularly, the contact resistance is small if the particle size of an electroconductive magnetic particles is small, since then the particles are closely contacted to the photosensitive member 1.

In this Embodiment 2, the particle resistance is large, and in addition, the magnetic brush layer 2*c* is constituted by electroconductive magnetic particles having a large particle size, so that contact resistance between the electroconductive magnetic particle and the photosensitive member is increased, and therefore, the time constant of the entire charging system is made slower.

As a further alternative, a resistor may be inserted between the voltage source S1 and the magnetic brush charger 2 to adjust the resistance value of the resistor in the structure constituted by the voltage source S1—resistor—magnetic brush charger 2—the photosensitive member to adjust the time constant.

If however the time constant is too large, the charged potential after the charging nip n is not sufficient, and therefore, the time constant of the charging system is preferably not more than the net charging nip passing time. Desirably, it is not more than one third the charging nip passing time.

<Embodiment 3>

As described with Embodiments 1 and 2, according to the present invention, the fog attributable to the AC bias can be suppressed in a charge injection contact type and AC applying type. In this invention, the charging property can be maintained in a repeated printing operations. The present invention will be described in this respects with the latter example.

In this example, the use is made with Embodiment 2., and the AC bias condition is changed to change the width ΔV of the potential deflection.

Table 3 shows the results of fog measurements after 3000 sheets printing in the Embodiments 1, 2, Comparison Example 1 and in this Embodiment 3 to Embodiment 6.

TABLE 3

| | | | | | Fog | |
|---|---|---|---|---|---|---|
| | τ | $2xV_{AC}$ | f | ΔV | Initial (%) | after 3000 sheets (%) |
| Comp. Ex. 1 | 0.004 | 1000 | 1000 | 62 | 4.7 | 4.0 |
| Embo. 1 | 0.004 | 1000 | 2000 | 31 | 1.8 | 2.0 |
| Embo. 2 | 0.008 | 1000 | 1000 | 31 | 2.3 | 2.1 |
| Embo. 3 | 0.008 | 400 | 1000 | 13 | 1.2 | 2.2 |
| Embo. 4 | 0.015 | 400 | 2000 | 3 | 0.8 | 2.2 |
| Embo. 5 | 0.015 | 200 | 1000 | 3 | 0.8 | 2.3 |
| Embo. 6 | 0.015 | 150 | 800 | 3 | 0.8 | 2.8 |

In Embodiment 6, the electroconductive magnetic particles constituting the magnetic brush layer 2*c* of the magnetic brush charger 2 have the resistance of $2\times10^8$ (Ω·cm) and a particle size of 50 (μm).

The magnetic brush resistance of the magnetic brush thus formed is approx. $3\times10^6\Omega$ when 100 V is applied, and approx. $8\times10^5\Omega$ when 1000 V is applied. In Embodiment 6, ΔV is 3 V, and the fog due to the AC bias application does not occur at the initial stage of printing, but with the repetition of the printing, the resistance of the magnetic brush charger 2 gradually increases by the introduction of the toner passed under the cleaning device 6 and the resulting reduction of the chance of contact of the charger to the photosensitive drum, and the improper charging results. When 3000 sheets were printed, the fog was 2.8%, but the ghost image of the previous image is produced due to the introduction of the toner to the charger.

On the other hand, this Embodiments 3, 4, 5 and Embodiments 1, 2, ΔV is not more than 100 V, the fog due to the AC bias does not occurs at the initial stage. And, in the repeated test, the ghost image is not produced because of the disturbance and swing effects of the toner by the AC bias since the applied AC bias is not less than 200 V, so that satisfactory charging property can be maintained. It is preferable that $2V_{AC}\geqq200$ is satisfied from the standpoint of prevention of the ghost image.

<Others>

Figure 10:
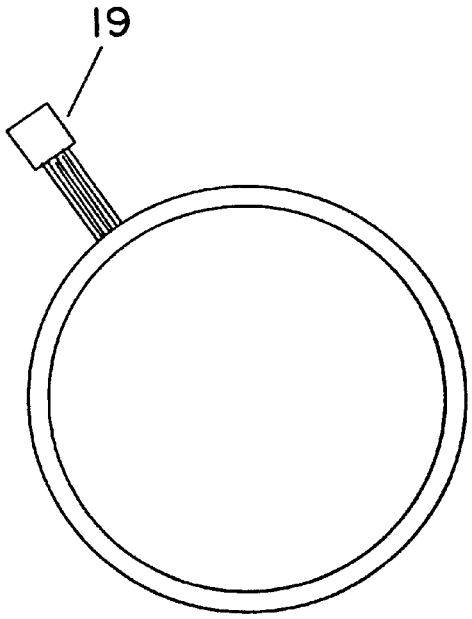
FIG. 10 is a schematic view of a brush charger.

1) The charging device of the present invention is applicable to charge a member to be charged as well as an image bearing member of an image forming apparatus.
2) The contact charger is not limited to a magnetic brush charger shown in the embodiment, but may be a fiber brush or furbrush charger (such as brush charger 19 is illustrated in FIG. 10, a charging roller or a charging blade of electroconductive rubber or electroconductive sponge, or it may be non-rotatable. The magnetic brush charger may be a rotatable magnet roller 2*a* having a surface treated as desired for electroconductivity to function as an electric energy supply electrode and electroconductive magnetic particles directly attracted on the magnet roller 2*a* to provide a magnetic brush layer 2*c*. It may be a non-rotatable magnetic brush charger.
3) In the injection charging type, the member to be charged preferably has a surface layer having a volume resistivity of $10^9$–$10^{14}$ Ω·cm. The image bearing member may be the photosensitive member of the above-described embodiments including an OPC photosensitive member coated with a surface layer (charge injection layer) in which electroconductive particles of $SnO_2$ or the like are dispersed, or a photosensitive member having a charge injection charging property such as (α-Si amorphous silicon) surface layer. A photosensitive member of inorganic semiconductor of CdS, Si or Sc is usable.

The image exposure means for imagewise exposure of the charged surface of the image bearing member in an image forming apparatus is not limited to the laser scanning exposure means for formation of digital latent image as in the foregoing embodiments, but may be an analog image exposure means using LED or another light emission element, a combination of a fluorescent lamp or another light emission element and a liquid crystal shutter or the like if an electrostatic latent image corresponding to the image information can be formed.

The image bearing member may be an electrostatic recording dielectric member. In such a case, the dielectric member surface is uniformly charged (primary charging) to a predetermined polarity and potential, and thereafter, the selective discharging is effected by discharging needle head, electron gun or another discharging means to form an intended electrostatic latent image.

The developing system and means for the electrostatic latent image is not limited to the reverse development as in the foregoing embodiments, but may be a regular developing system type.

5) The transfer method is not limited to the roller transfer used in the foregoing embodiments, but blade transfer or another contact transfer charging type is usable, and the present invention is applicable to an image forming apparatus wherein multi-color or full-color image is formed using a transfer drum, a transfer belt or an intermediary transfer member.
6) The waveform of the AC bias component of the applied charging bias to the contact charger may be a sunisoidal wave, rectangular wave, triangular wave or the like. It may be in the form of a rectangular wave AC voltage provided by periodical ON/OFF of a DC voltage source. Therefore, the superimposed voltage of the AC voltage and the DC voltage applied to the contact charger may be provided by a DC voltage source alone without use of an AC voltage source. The waveform of the AC voltage is such that voltage level changes periodically.

7) The process cartridge 10 is not limited to the one disclosed above, but may contain any image formation process means.

8) The present invention is applicable to an image display device wherein a toner image is formed on a rotatable belt of an electrophotographic photosensitive member or an electrostatic recording dielectric member (image bearing member) through charging, latent image formation and development processes corresponding to a desired information, and the toner image is displayed through a window, wherein the image bearing member is repeatedly used. The image forming apparatus covers such an image display device.

As described in the foregoing, according to the present invention, the improper charging in the form of a fine potential non-uniformity on the surface of the member to be charged attributable to the application of the AC bias to the contact charger can be suppressed, and in an image forming apparatus or a process cartridge, the image non-uniformity or fog of the output image due to AC bias application can be suppressed, so that high quality image recording is accomplished with stability in long term use.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus for charging a member to be charged which has a surface layer having a volume resistivity of $1\times10^9$–$1\times10^{14}$ Ωcm, said apparatus comprising:

a charging member contactable to the member to be charged to electrically charge the member to be charged, the charging member being supplied with a voltage having an AC voltage component;

wherein a time constant τ (sec) of the member to be charged and said charging member, a frequency f (Hz) of the AC voltage component, and an effective voltage $V_{AC}$ (V) of the AC voltage component, satisfy:

$$2V_{AC}\{1-\exp(-\tfrac{1}{2}f/\tau)\}/\{1+\exp(-\tfrac{1}{2}f/\tau)\}\leqq 50.$$

2. An apparatus according to claim 1, wherein $V_{AC}\geqq 100$ is satisfied.

3. An apparatus according to claim 1, wherein said charging member has a magnetic brush of magnetic particles contactable to the member to be charged.

4. An apparatus according to claim 1, wherein said charging member has a fiber brush contactable to the member to be charged.

5. An apparatus according to claim 1, wherein the surface layer is provided with an insulation member and electroconductive particles dispersed in the insulation member.

6. An apparatus according to claim 1, wherein the voltage applied to said charging member is a voltage in the form of an AC voltage biased with a DC voltage.

7. An image forming apparatus comprising:

a member to be charged which has a surface layer having a volume resistivity of $1\times10^9$–$1\times10^{14}$ Ωcm;

image forming means for forming an image on said member to be charged, said image forming means including a charging member contactable to the member to be charged to charge the member to be charged, and the charging member being supplied with a voltage having an AC voltage component:

wherein a time constant τ (sec) of the member to be charged and said charging member, a frequency f (Hz) of the AC voltage component, and an effective voltage $V_{AC}$ (V) of the AC voltage component, satisfy:

$$2V_{AC}\{1-\exp(-\tfrac{1}{2}f/\tau)\}/\{1+\exp(-\tfrac{1}{2}f/\tau)\}\leqq 50.$$

8. An apparatus according to claim 7, wherein $V_{AC}\geqq 100$ is satisfied.

9. An apparatus according to claim 7, wherein said charging member has a magnetic brush of magnetic particles contactable to the member to be charged.

10. An apparatus according to claim 7, wherein said charging member has a fiber brush contactable to the member to be charged.

11. An apparatus according to claim 7, wherein the surface layer is provided with an insulation member and electroconductive particles dispersed in the insulation member.

12. An apparatus according to claim 7, wherein the voltage applied to said charging member is a voltage in the form of an AC voltage biased with a DC voltage.

13. An apparatus according to claim 7 or 11, wherein the member to be charged is provided with an electrophotographic photosensitive layer inside the surface layer.

* * * * *

UNITED STATES PATENT AND TRADEMARK OFFICE

CERTIFICATE OF CORRECTION

PATENT NO. : 6,035,162

DATED : March 7, 2000

INVENTOR : Yasunori Chigono

It is certified that error appears in the above-identified patent and that said Letters Patent is hereby corrected as shown below:

COVER PAGE

Under [57] Abstract, line 6, "e" should read --a--.

COLUMN 3

Line 26, "thereof" should read --thereof (b).--.

COLUMN 4

Line 40, "an" should read --on--; and
Line 56, "Into" should read --into--.

COLUMN 5

Line 1, "Photosensitive" should read --photosensitive--; and
Line 33, "Pref-" should read --pref- --.

COLUMN 9

Line 13, "sin" should read --sine--.

COLUMN 10

Line 14, "was" should read --is--.

UNITED STATES PATENT AND TRADEMARK OFFICE

CERTIFICATE OF CORRECTION

PATENT NO. : 6,035,162

DATED : March 7, 2000

INVENTOR : Yasunori Chigono

It is certified that error appears in the above-identified patent and that said Letters Patent is hereby corrected as shown below:

COLUMN 11

Line 22, "a" should be deleted;
Line 25, "2.," should read --2,--; and
Line 63, "this" should read --in these--.

COLUMN 12

Line 11, "is" should be deleted;
Line 12, "10," should read --10),--; and
Line 63, "sunisoidal" should read --sinusoidal--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*